US005308917A

United States Patent [19]

Kitamura et al.

[11] Patent Number: 5,308,917

[45] Date of Patent: May 3, 1994

[54] KEYBOARD TOUCH RESPONSE SETTING APPARATUS

[75] Inventors: Mineo Kitamura; Yutaka Washiyama, both of Hamamatsu, Japan

[73] Assignee: Kabushiki Kaisha Kawai Gakki Seisakusho, Shizuoka, Japan

[21] Appl. No.: 984,519

[22] Filed: Dec. 2, 1992

[30] Foreign Application Priority Data

Dec. 3, 1991 [JP] Japan ..... 3-348029

[51] Int. Cl.[5] ..... G10H 1/18; G10H 1/46

[52] U.S. Cl. ..... 84/607; 84/615; 84/626; 84/633; 84/DIG. 7

[58] Field of Search ..... 84/607, 615-620, 84/626, 627, 633, DIG. 7

[56] References Cited

U.S. PATENT DOCUMENTS 5,173,567 12/1992 Fujita ..... 84/607

5,241,124 8/1993 Adachi et al. ..... 84/607

*Primary Examiner*—Stanley J. Witkowski

[57] ABSTRACT

This invention discloses a touch response setting apparatus with which a player can rewrite a touch response curve for converting key touch data into tone generation tone level data. The touch response curve is defined by a polygonal line having at least a low touch setting point and a high touch setting point, and is stored in a RAM which receives a key touch input as an address, and outputs tone level data. In a test mode, low-touch (piano) and high-touch (forte) key operations corresponding to the touch setting points are performed, and an average value of a plurality of key depression strengths upon these key operations is obtained. When a predetermined value is given as tone level data corresponding to a touch average value at each touch setting point, the inclination of each segment of the polygonal line is determined. Thus, points on the segments are interpolated, and generated touch response curve data is stored in the RAM.

7 Claims, 8 Drawing Sheets

FIG. 7

| |
|---|
| 1ST p-TOUCH DATA |
| 2ND p-TOUCH DATA |
| 3RD p-TOUCH DATA |
| ⋮ |
| 10TH p-TOUCH DATA |
| 1ST mf-TOUCH DATA |
| 2ND mf-TOUCH DATA |
| ⋮ |
| 10TH mf-TOUCH DATA |
| 1ST f-TOUCH DATA |
| ⋮ |
| 10TH f-TOUCH DATA |
| SUM OF p-TOUCH DATA (2 BYTES) |
| SUM OF mf-TOUCH DATA (2 BYTES) |
| SUM OF f-TOUCH DATA (2 BYTES) |
| p-TOUCH AVERAGE($p_A$) |
| mf-TOUCH AVERAGE($mf_A$) |
| f-TOUCH AVERAGE($f_A$) |

KEYBOARD TOUCH RESPONSE SETTING APPARATUS

BACKGROUND OF THE INVENTION

1. Field of the Invention

The present invention relates to a touch response setting apparatus in a keyboard electronic musical instrument.

2. Description of the Related Art

In, e.g., an electronic musical instrument having a keyboard, a response of the tone generation volume corresponding to the touch level of the keyboard is one important factor in music expression. Therefore, it is preferable that the touch response can be adjusted or selected according to a player's favor or skill.

In a low-grade electronic piano, only one type of touch response is available, and is set to be similar to that of an acoustic piano. In contrast to this, a high-grade model has a plurality of types of touch response data, and one of these touch response data is determined in correspondence with a tone color selected by a player or a play pitch.

In addition, an electronic musical instrument which has operation members for performing selection from a plurality of types of touch curves, tone colors, and the like on a panel, and can combine these parameters, is also known.

In any case, in a conventional electronic musical instrument, a touch response curve which defines the relationship between the touch level and the tone generation level (volume) is determined by the designer of the electronic musical instrument. Therefore, even when one of a plurality of touch response curves can be selected like in the high-grade model, a player himself or herself cannot desirably set a touch response curve matching with his or her skill, a play state, or the like.

More specifically, a touch response curve determined by the designer of an electronic musical instrument is an average one matching with a large number of players, and does not often match with the feeling or skill of an individual player. Therefore, for example, even when a player intends to play in pianissimo, considerably loud tones are unexpectedly generated, or some players cannot control delicate touches of the keyboard.

SUMMARY OF THE INVENTION

It is an object of the present invention to provide a touch response setting apparatus with which a player can desirably set a touch response of a keyboard on the basis of his or her feeling or skill.

A touch response setting apparatus for a keyboard according to the present invention comprises a curve memory for storing conversion curve data defined by a polygonal line having at least low and high touch setting points, and outputting tone level data for tone generation in response to key touch data, touch detection means, having a test mode for detecting a key depression strength, for, when the apparatus operates in the test mode, detecting key depression strength values obtained upon a plurality of depressions of a key on a keyboard by a player in correspondence with the touch setting points, and calculating average value data of the plurality of key depression strength values, and interpolation means for determining an inclination of each segment of the polygonal line on the basis of the average value data and a predetermined tone level value of the corresponding touch setting point, calculating a correspondence between input and output values corresponding to a segmentation point on each segment by a linear interpolation, and storing the calculated correspondence as the conversion curve data in the curve memory.

BRIEF DESCRIPTION OF THE DRAWINGS

FIG. 7 shows the memory map for storing average data of tones;

DETAILED DESCRIPTION OF THE PREFERRED EMBODIMENT

Figure 1:
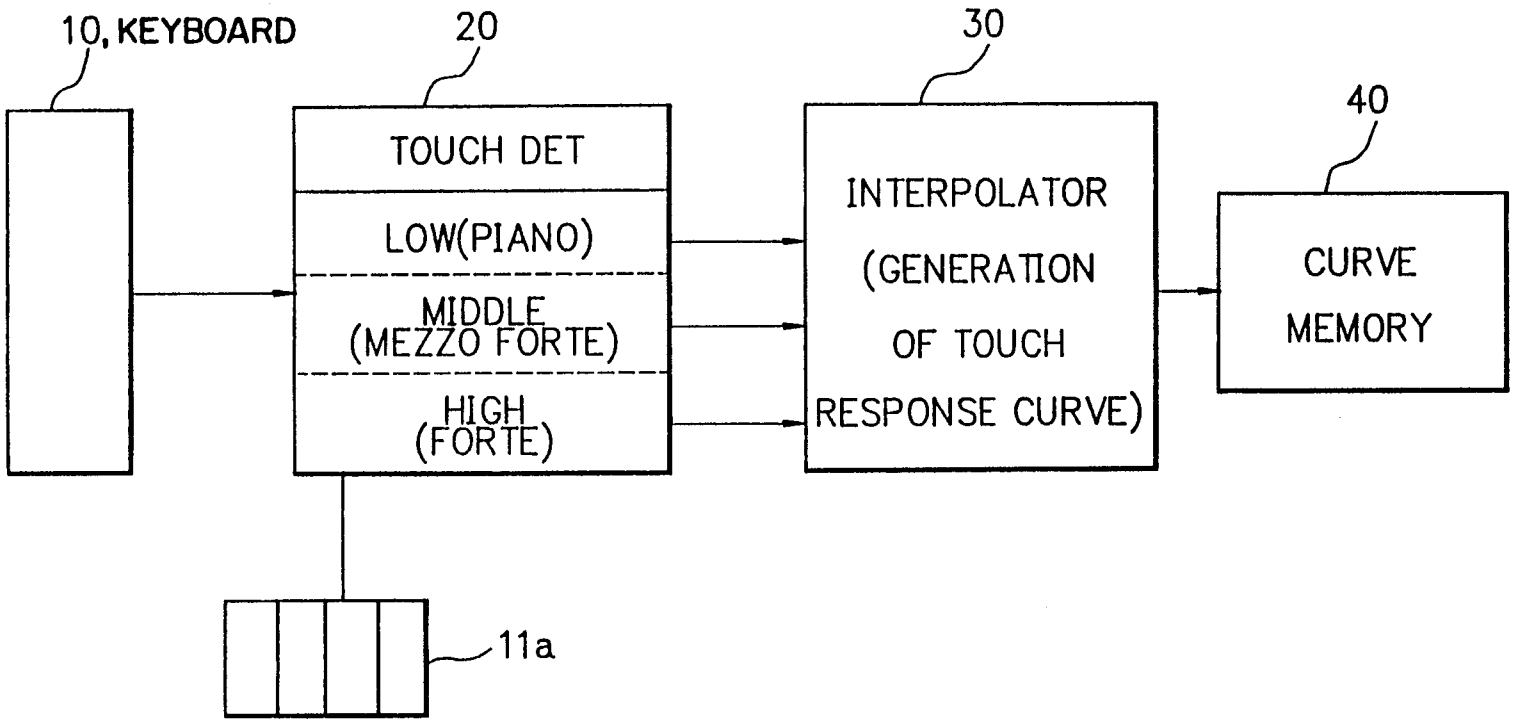
FIG. 1 is a schematic block diagram of a keyboard touch response setting apparatus.

The preferred embodiment of the present invention will be described hereinafter with reference to the accompanying drawings. FIG. 1 is a schematic block diagram showing a keyboard touch response setting apparatus according to the present invention.

As shown in FIG. 1, the keyboard touch response setting apparatus of the present invention is applied to, e.g., an electronic musical instrument, and comprises a keyboard 10 consisting of a plurality of key switches, a touch detector 20, an interpolator 30, a curve memory 40 for storing touch response curve, and the like.

The curve memory 40 comprises, e.g., a RAM. As shown in the schematic diagram in FIG. 2, the curve memory 40 receives a depression pressure value p obtained from the keyboard 10 as an address, and outputs stored touch response curve data as a tone level (key velocity) v.

The touch detector 20 shown in FIG. 1 detects depression pressure (touch) values p in units of strengths in association with at least three setting points, i.e., low-touch (piano), middle-touch (mezzo forte), and high-touch (forte) setting points. In this case, when the depression pressure is detected, the keyboard is depressed a plurality of number of times, and an average value of the plurality of number of times of depression is detected. A player can input a depression pressure while listening to a tone generated by the electronic musical instrument. More specifically, the player performs keyboard operations for touch detection while recognizing the tone level corresponding to the touch strength according to his or her feeling. Note that the pitch of a key to be used on the keyboard is not particularly limited.

Touch data corresponding to depression pressure setting points of the respective tone levels low, middle, and high touches) detected in this manner are supplied to the interpolator 30. The interpolator 30 linearly interpolates the input touch data, thus forming a response curve representing touch-tone level characteristics. The response curve uniquely defines the relationship between an input (touch}and an output (tone level), and is stored in the curve memory 40 which comprises, e.g., a RAM for receiving an input as an address, and outputting stored data.

The input axis of the response curve corresponds to linear touch (depression pressure) data of, e.g., 256 steps, and the output axis thereof corresponds to data obtained by interpolating tone levels corresponding to low, middle, and high touches detected by the touch detector 20.

Figure 2:
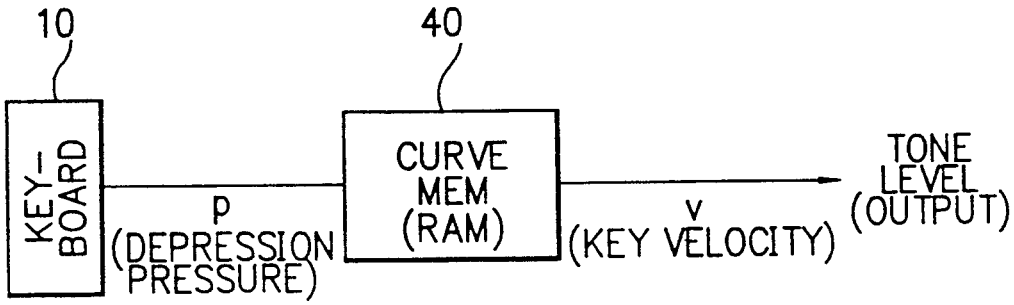
FIG. 2 is a diagram for explaining an operation of main part of the keyboard touch response setting apparatus.

As shown in FIG. 2, depression pressure data (touch data) p in play information obtained from the keyboard 10 is converted into a response output representing a desired tone level value according to the touch response curve set in the curve memory 40. Therefore, a tone level to be played is precise reproduction of the touch-tone level characteristics pre-set by the touch detector 20 and the interpolator 30 shown in FIG. 1.

For example, when a player has a low skill level, and cannot perform delicate touch control of a piano tone, he or she can set the response curve so that a piano tone can be generated even at a relatively high touch. Similarly, when a player feels that touches corresponding to low to high tone levels do not match with his or her feeling, he or she can modify the response curve so as to obtain an optimal touch-tone level relationship in the low to high touch regions for the player.

Figure 3:
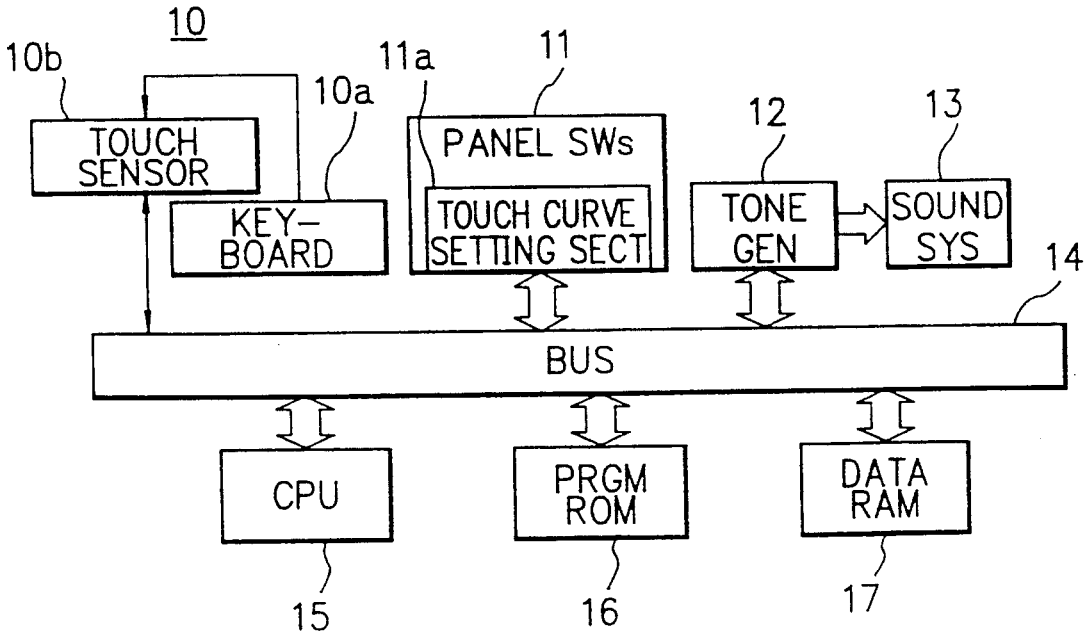
FIG. 3 is a schematic block diagram showing an arrangement of an electronic musical instrument adopting the keyboard touch response setting apparatus.

FIG. 3 shows the arrangement of an electronic musical instrument adopting the keyboard touch response setting apparatus of the present invention.

This electronic musical instrument is constituted by a microprocessor system, and the keyboard 10 (a keyboard 10*a* and a touch sensor 10*b*), panel switches 11, a tone generator 12, and the like are connected to a microprocessor consisting of a CPU 15, a program ROM 16, and a data RAM 17 through a bus 14.

The CPU 15 reads a play operation of the keyboard 10*a* from the touch sensor 10*b* on the basis of a program stored in the ROM 16, forms a tone control signal from play data according to parameters such as a tone color, a tempo, and the like set using the panel switches 11, and outputs the tone control signal to the tone generator 12.

The tone generator 12 comprises a plurality of PCM tone sources for a piano tone, a flute tone, a bass tone, and the like, and a plurality of channels of tone generation circuits each for processing the envelope, the duration, and the like of an output from each of these PCM tone sources on the basis of the tone control signal, and for generating a tone signal. The tone signal formed by the tone generator 12 is supplied to a sound system 13 comprising an amplifier, a loudspeaker, and the like.

Figure 4:
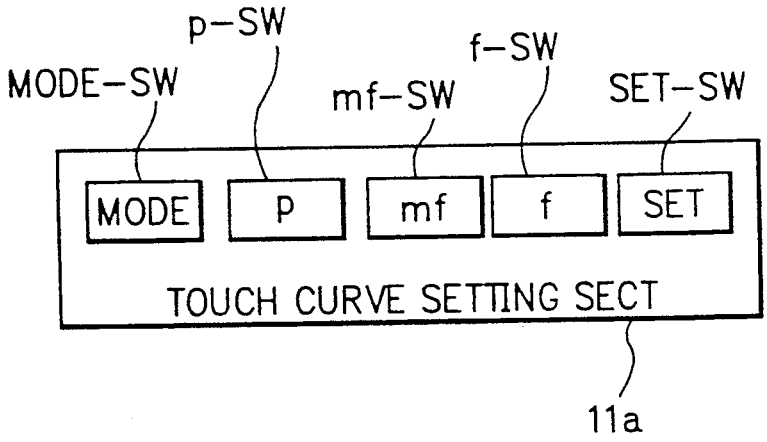
FIG. 4 is a plan view showing an example of a touch curve setting section.

The panel switches 11 have a touch curve setting section 11*a*, which is arranged as shown in the plan view of FIG. 4. The touch curve setting section 11*a* has various switches SW such as a mode switch MODE-SW for selecting a touch curve setting mode, a piano setting switch p-SW for setting a piano (low) touch, a mezzo forte setting switch mf-SW for setting a mezzo forte (middle) touch, a forte setting switch f-SW for setting a forte (high) touch, a set switch SET-SW for storing the set curve in the curve memory 40, and the like. The touch curve is set by sequentially depressing these switches SW according to the sequence shown in the flow chart of FIG. 5.

Figure 5:
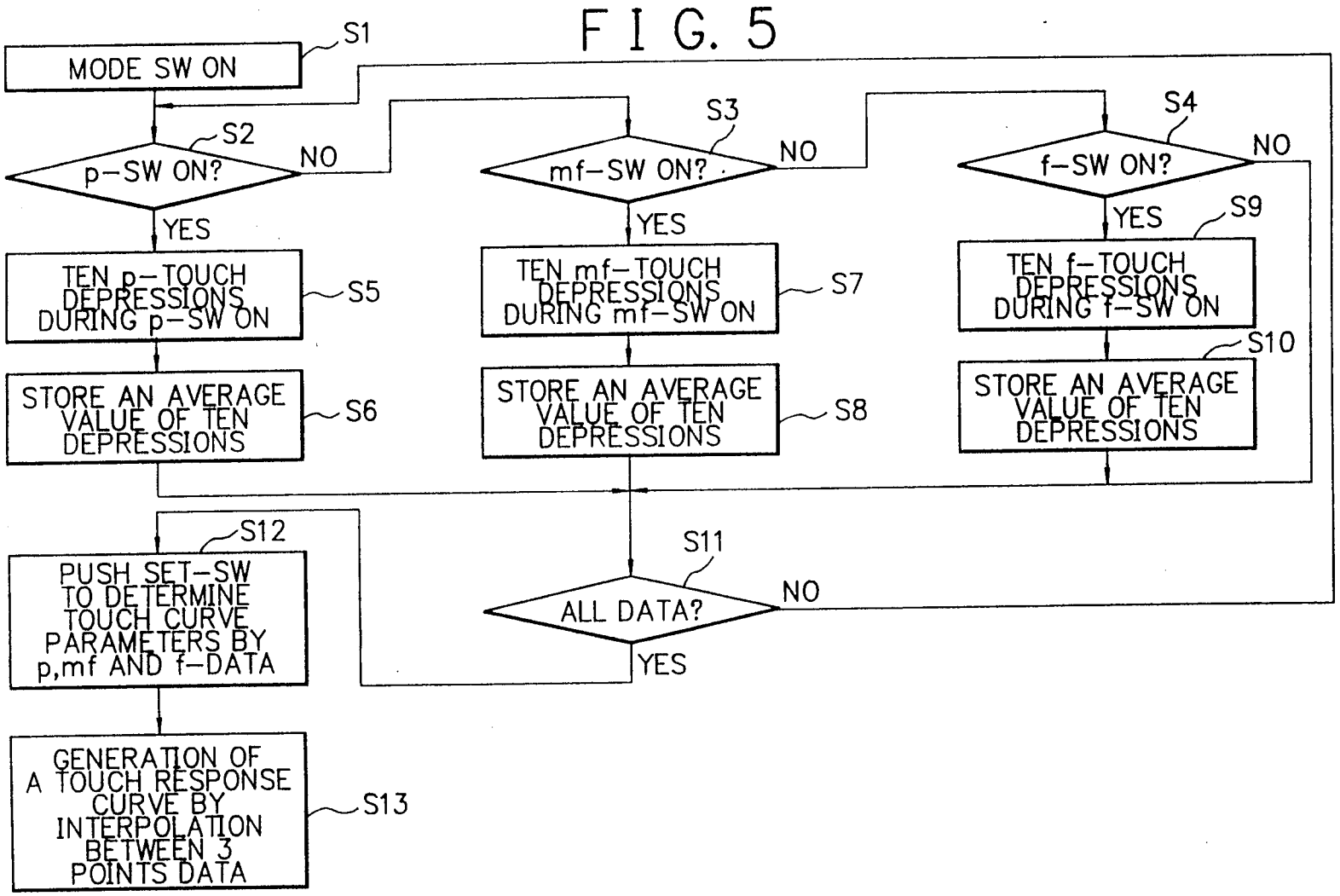
FIG. 5 is a flow chart showing processing for generating touch curve data.

In the flow chart of FIG. 5, when the mode switch MODE-SW is depressed in step S1, the touch curve setting mode is set. When one of the piano setting switch p-SW, the mezzo forte setting switch mf-SW, and the forte setting switch f-SW is then depressed, it is detected in a corresponding one of steps S2 to S4, and touch data of a corresponding tone level can be set.

More specifically, for example, an arbitrary key is depressed 10 times at a piano touch in step S5 while depressing the piano setting switch p-SW, and average data pA of 10 depressions is stored in the RAM 17 in step S6. Similarly, an arbitrary key is depressed 10 times at a mezzo forte touch while depressing the mezzo forte setting switch mf-SW, and average data mfA of 10 depressions is stored in the RAM 17 (steps S7 and S8). Furthermore, an arbitrary key is depressed 10 times at a forte touch while depressing the forte setting switch f-SW, and average data fA of 10 depressions is stored in the RAM 17 (steps S9 and S10).

With these operations, all the touch data can be fetched (step S11). Then, the set switch SET-SW is depressed to convert the input data into touch curve parameters (step S12), and the three data are linearly interpolated to generate touch response curve data (step S13).

Figure 6:
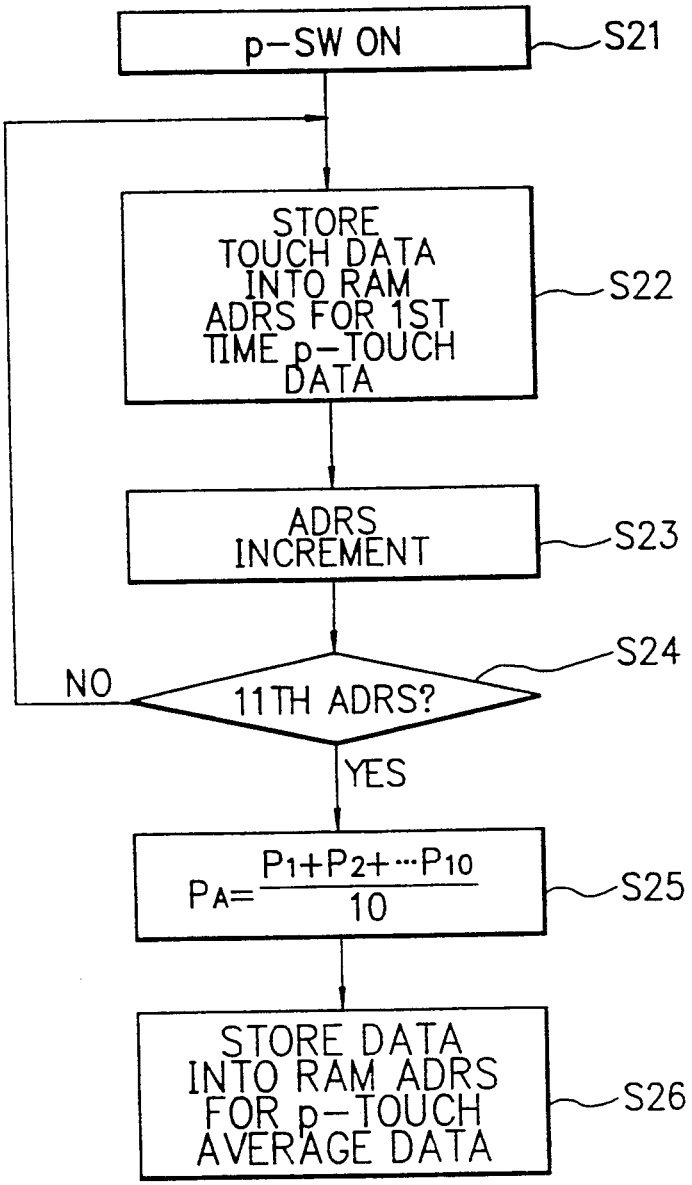
FIG. 6 is a flow chart showing processing for detecting touch data corresponding to a depression pressure detection point for a low touch.

FIG. 6 is a flow chart showing the details of the sequence in steps S2, S5, and S6 in FIG. 5, and FIG. 7 shows the memory map of the fetched touch data.

As shown in FIG. 6, when the piano setting switch p-SW is turned on (step S21), touch data obtained from the touch sensor 10*b* upon touching of the keyboard 10*a* is stored at an address corresponding to the first p-touch data in the RAM. Similarly, 10 touch data are fetched while incrementing the address by 1 (steps S23 and S24).

Then, the average pA of the 10 touch data is calculated, and the average data is written at the corresponding address in the RAM (steps S25 and S26). Thereafter steps S3, S7, S8, and steps S4, S9, and S10 in FIG. 5 are executed in the same manner as described above.

Figure 11:
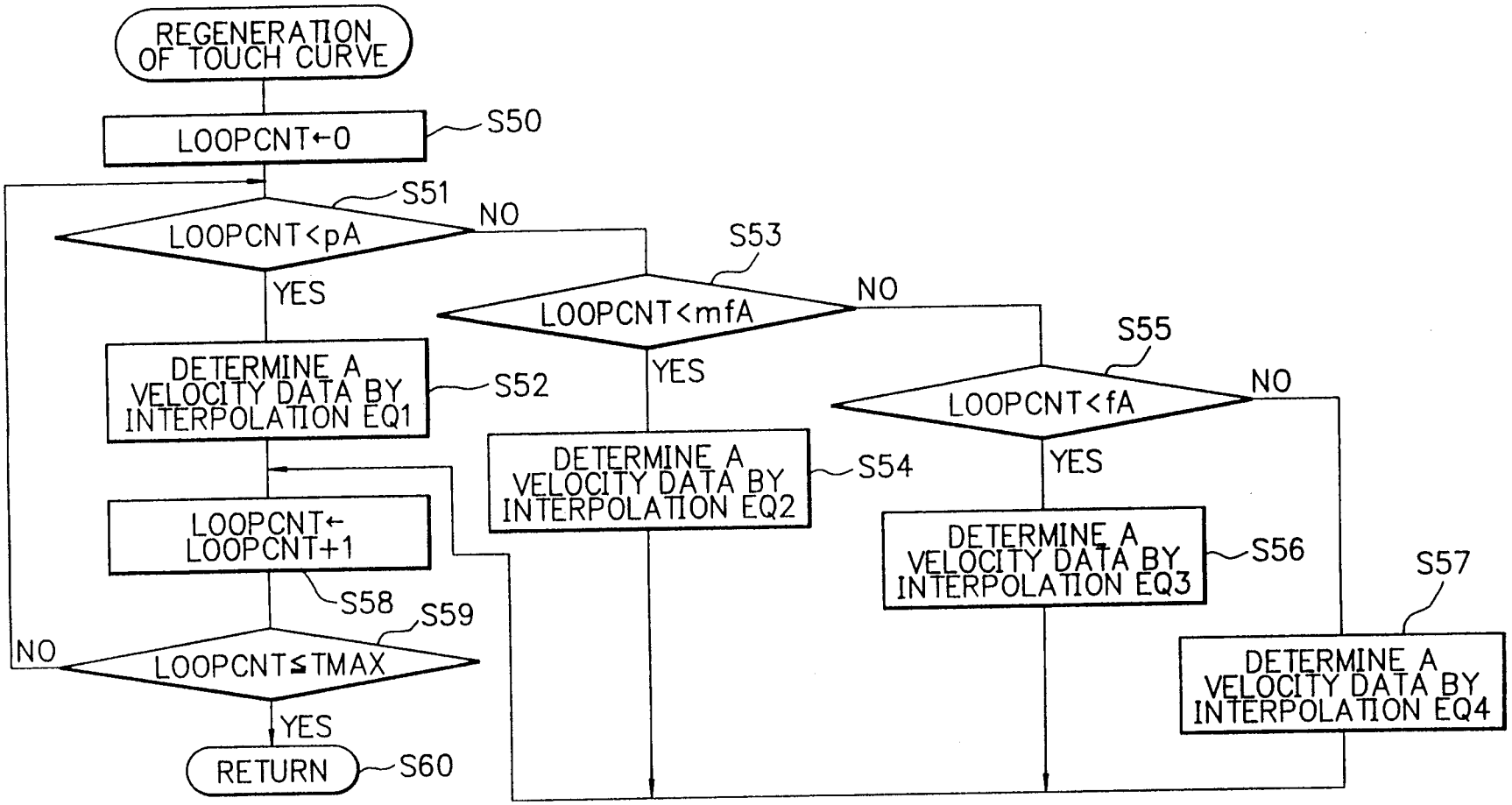
FIG. 11 is a flow chart showing processing for regenerating touch curve data.

FIG. 11 is a flow chart showing touch curve data regeneration processing. In this processing, new touch curve data VELO is generated on the basis of average data of the low (piano) touch p, the middle (mezzo forte) touch mf, and the high (forte) touch f.

In step S50, 0 is set in a loop counter LOOPCNT. In step S51, the content of the loop counter LOOPCNT is compared with the touch average data pA at the low touch setting point. In a region below the low touch setting point, a corresponding velocity value VELO(-LOOPCNT) is obtained by linear interpolation in step S52. An interpolation formula (1) used in this case is:

$$VELO(LOOPCNT) = \frac{VELOL}{PA} \times LOOPCNT \quad (1)$$

where VELOL is the predetermined velocity value determined in correspondence with the low touch setting point.

The velocity value calculated in this manner is stored at the position of an address LOOPCNT in the curve memory (RAM) 40.

In a region above the low touch setting point, the content of the loop counter is compared with the touch average data mfA at the middle touch setting point in step S53. If the content of the loop counter falls within a range between the low and middle touch setting points, a corresponding velocity value VELO(LOOPCNT) is obtained by linear interpolation in step S54. An interpolation formula (2) used in this case is:

$$VELO(LOOPCNT) = \frac{VELOM - VELOL}{mfA - pA} \times (LOOPCNT - pA) + VELOL \quad (2)$$

where VELOM is the predetermined velocity value corresponding to the middle touch setting point.

If a region above the middle touch setting point is determined in step S53, the flow advances to step S55 to compare the content of the loop counter with the touch average data fA at the high touch setting point. If the content of the loop counter falls within a range between the middle and high touch setting points, a corresponding velocity value VELO(LOOPCNT) is calculated by linear interpolation in step S56. An interpolation formula (3) used in this case is:

$$VELO(LOOPCNT) = \frac{VELOH - VELOM}{fA - mfA} \times (LOOPCNT - mfA) + VELOM \quad (3)$$

where VELOH is the predetermined velocity value corresponding to the high touch setting point.

If a region above the high touch setting point is determined in step S55, a curvilinear interpolation is performed in step S57. An interpolation formula (4) used in this case is:

$$VELO(LOOPCNT) = \frac{VMAX - VELOH}{ff - fA} \times (LOOPCNT - fA) + VELOH \quad (4)$$

where VMAX and ff are respectively the maximum velocity value of the touch curve, and the maximum touch data.

The interpolations in steps S52, S54, S56, and S57 are repetitively performed while incrementing the content of the loop counter LOOPCNT by 1 in step S58. If it is determined in step S59 that the content of the loop counter LOOPCNT has reached maximum touch curve data TMAX, the flow returns to the main routine in step S60.

With the above-mentioned processing, velocity values corresponding to all the touch curve data values (0 to 255) are stored in the curve memory (RAM) 40. The velocity value stored in the RAM 40 is read out using touch curve data detected upon depression of a key.

Figure 8:
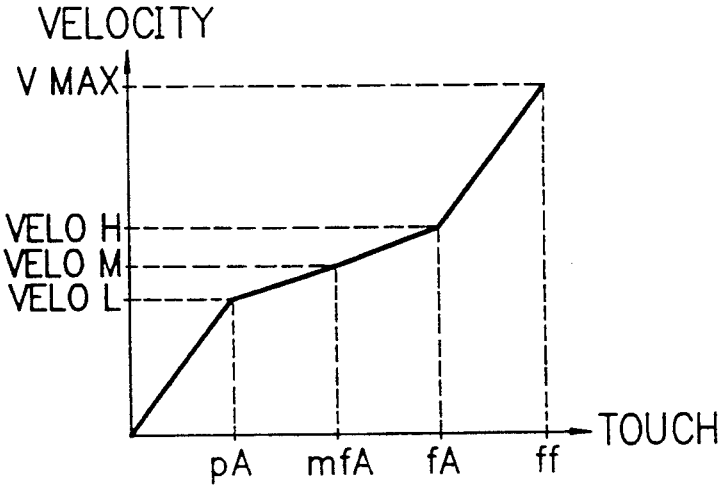
FIG. 8 is a graph showing a standard touch curve.
Figure 9:
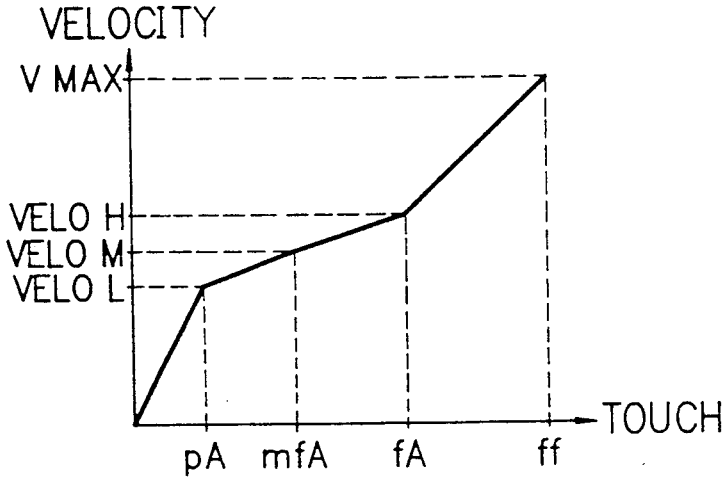
FIG. 9 is a graph showing a touch curve set when the touch pressure of a player is low.
Figure 10:
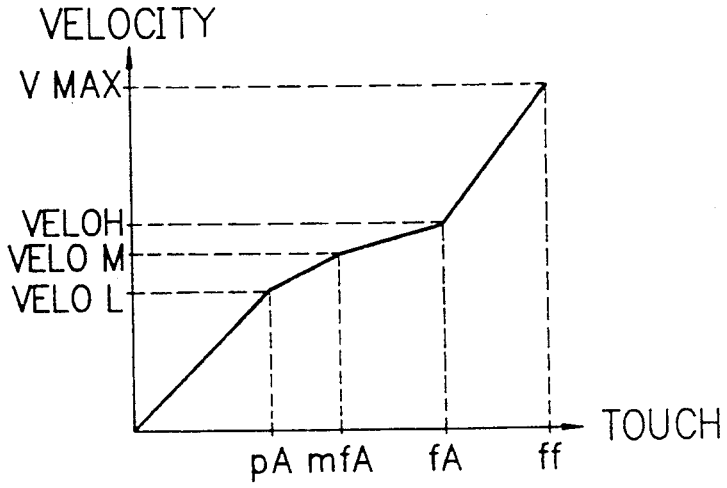
FIG. 10 is a graph showing a touch curve set when the touch pressure of a player is high.

FIGS. 8 to 10 show touch response curves regenerated by the processing shown in FIG. 11. The touch response curve shown in FIG. 8 represents a case wherein key depressions are performed at an average strength FIG. 9 shows the touch response curve generated when the key depression strength is lower than an average value. In this case, the change rate of the velocity value with respect to a low touch is increased.

Furthermore, FIG. 10 shows the touch response curve generated when the key depression strength is higher than an average value. In this case, in contrast to the curve shown in FIG. 9, the change rate of the velocity value with respect to a high touch is increased.

Since the keyboard touch response setting apparatus of this embodiment generates a touch response curve in this manner, the touch response curve can be arbitrarily changed by changing piano (p), mezzo forte (mf), and forte (f) touch inputs in the touch curve setting mode.

When the capacity of the curve memory 40 is increased, a plurality of response curves can be set. Therefore, for example, different curves may be set in units of octaves of pitches, or may be set in units of different tone colors (instruments). In addition, a response curve corresponding to a loudness mode may be set.

In the above-mentioned average touch data generation sequence shown in FIG. 11, it is more preferable to add an algorithm for calculating an average value after data considerably different from the average value is removed. Furthermore, a judgment/display means may be added. The judgment/display means may judge a degree of variation in touch input, and when a predetermined number of touch data with less variations are obtained, "good" may be displayed; when variations are large, "no good" may be displayed.

In the above embodiment, a touch response curve is regenerated using the fixed velocity values VELOL, VELOM, and VELOH for the sake of simplicity. However, for example, the addresses of detection points may be fixed like 60, 120, and 180, and the velocity values may be changed in correspondence with average values of touch data input at these detection points, thereby regenerating a touch response curve.

As described above, the present invention comprises a test mode for detecting the depression pressure of a player. In the test mode, the actual touch strength of the keyboard by the player is detected a plurality of number of times, and a touch response curve for defining the relationship between the touch level and the tone generation level is generated on the basis of average value data of the plurality of touch strengths. In addition, the generated touch response curve is stored in the curve memory, and is read out in a play mode to be used as a tone generation control touch curve. For this reason, an optimal correspondence between the touch pressure and the tone generation level for the player can be set, and tone generation control matching with the player's skill, a play state, and the like can be performed.

What is claimed is:

1. A keyboard touch response setting apparatus comprising:

a curve memory for storing conversion curve data defined by a polygonal line having at least low and high touch setting points, and outputting tone level data for tone generation in response to key touch data;

touch detection means, having a test mode for detecting a key depression strength, for, when said apparatus operates in said test mode, detecting key depression strength values obtained upon a plurality of depressions of a key on a keyboard by a player in correspondence with the touch setting points, and calculating average value data of the plurality of key depression strength values; and interpolation means for determining an inclination of each segment of the polygonal line on the basis of the average value data and a predetermined tone level value of the corresponding touch setting point, calculating a correspondence between input and output values corresponding to a segmentation point on each segment by a linear interpolation, and storing the calculated correspondence as the conversion curve data in said curve memory.

2. An apparatus according to claim 1, wherein the touch setting points include low, middle, and high touch setting points.

3. An apparatus according to claim 1, wherein said curve memory comprises a RAM having a linear address space, the key touch data is supplied to an address input of said RAM, and the tone level data is obtained as a data output of said RAM.

4. An apparatus according to claim 3, wherein the touch strength average value of the plurality of key depressions is converted into an integer, the converted value is assigned to an address of the curve memory, and a predetermined tone level value of the touch setting point is stored at the address.

5. An apparatus according to claim 4, wherein said interpolation means calculates the tone level values for all addresses of said curve memory, and stores the calculated values as the conversion curve data in said curve memory.

6. An apparatus according to claim 5, wherein minimum and maximum tone level values corresponding to minimum and maximum addresses of said curve memory are predetermined.

7. An apparatus according to claim 1, wherein said touch detection means comprises selection means, corresponding to the touch setting points, for selecting one of the touch setting points in said test mode.

* * * * *